United States Patent [19]

Fromont et al.

[11] 4,408,470

[45] Oct. 11, 1983

[54] PROCEDURE AND DEVICE FOR ROLLING METALS WITHOUT STRESS

[75] Inventors: Jacques Fromont, Vanves; Marcel Plançon, Le Chesnay, both of France

[73] Assignee: Jeumont-Schneider Corporation, Puteaux, France

[21] Appl. No.: 266,916

[22] Filed: May 26, 1981

[30] Foreign Application Priority Data

May 28, 1980 [FR] France ..... 80 11796

[51] Int. Cl.[3] ..... B21B 37/00

[52] U.S. Cl. ..... 72/8; 72/11; 72/19; 364/472

[58] Field of Search ..... 72/8–11, 72/19, 29; 364/472

[56] References Cited

U.S. PATENT DOCUMENTS

| | | | |
|---|---|---|---|
| 3,688,532 | 9/1972 | Silva | 72/8 |
| 3,940,960 | 3/1976 | Tanifuji et al. | 72/19 |
| 4,087,859 | 5/1978 | Anbe | 72/8 |
| 4,126,028 | 11/1978 | Chapront | 72/19 |
| 4,240,147 | 12/1980 | Morooka et al. | 72/8 |
| 4,292,825 | 10/1981 | Morooka et al. | 72/8 |
| 4,335,435 | 6/1982 | Miura | 72/12 |

FOREIGN PATENT DOCUMENTS

| | | |
|---|---|---|
| 2354154 | 1/1978 | France . |
| 2395086 | 1/1979 | France . |

*Primary Examiner*—Lowell A. Larson

*Attorney, Agent, or Firm*—Rines and Rines, Shapiro and Shapiro

[57] ABSTRACT

The invention involves a procedure having three key stages: In the first stage, just prior to the introduction of the metal into stand (n+1), the value of the rolling torque in stand (n) is determined and recorded. Then, in the second stage, when the metal is introduced into stand (n+1), the value of the rolling torque in stand (n) is held constant by controlling the speed regulator of stand (n) up to the time the metal is introduced into stand (n+2). Finally, in the third stage, which continues until the rolling operation in stand (n) has been completed, the voluminal flow of the metal is held constant at the line of each stand by applying a multiplier coefficient to the signal representing the ratio between the speeds of two successive stands.

9 Claims, 2 Drawing Figures

PROCEDURE AND DEVICE FOR ROLLING METALS WITHOUT STRESS

Figure 1:
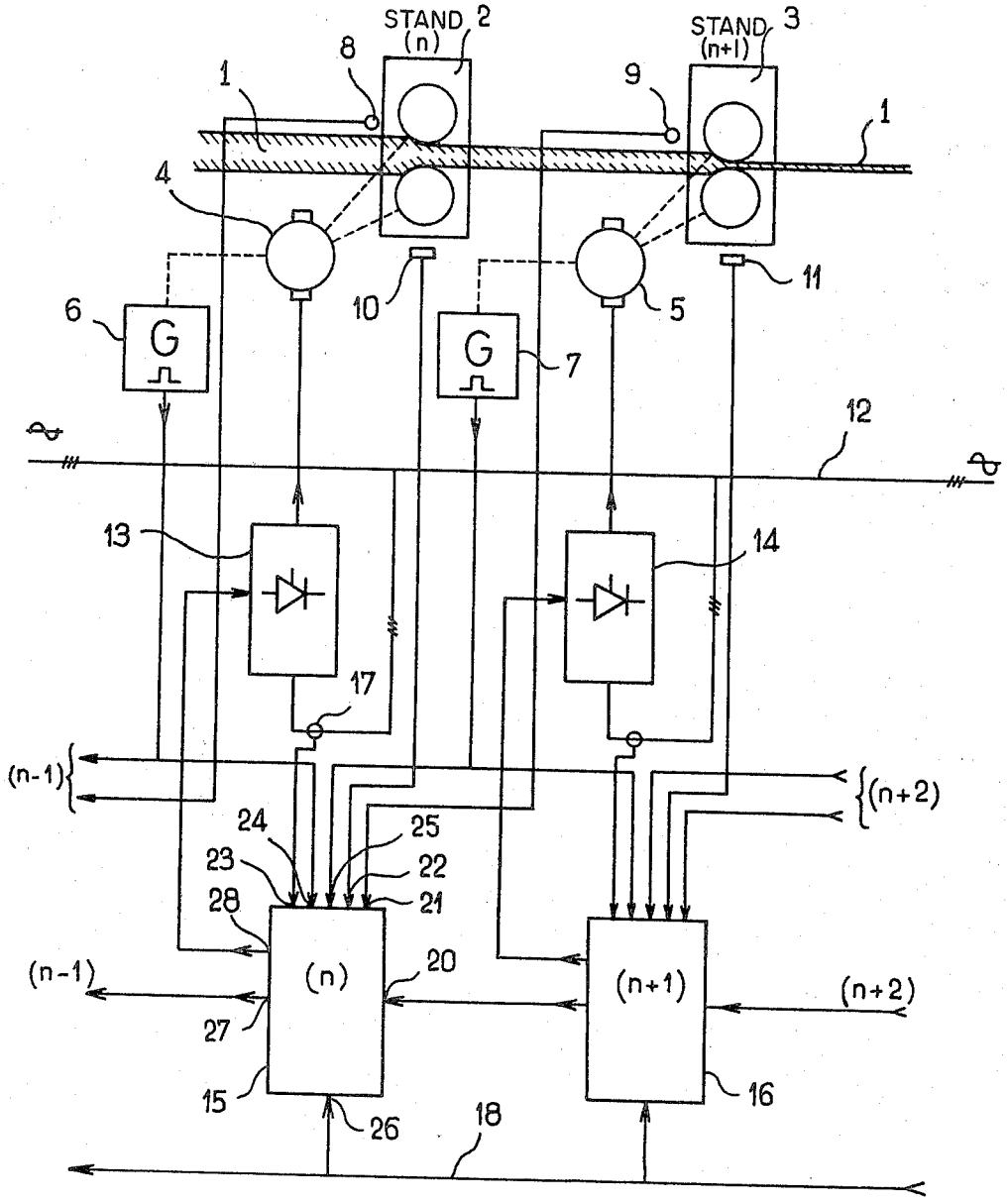

The present invention pertains to the rolling of metals without stress. More precisely, it concerns a procedure and a device for carrying out such rolling which can be used in conjunction with a continuous rolling mill incorporating at least two non-reversible stands, whose drive motors are controlled by a circuit connected to a speed regulator.

Procedures are known for detecting and correcting possible tension or compression of the metal between two successive stands. In these procedures, the amount of forward or rearward slip of the metal in each stand is regulated as a key characteristic of any stress on the metal. For example, French Pat. No. 2 395 086 describes such a procedure.

For one thing, the speed measurement devices that must be used are generally either inaccurate, as in the case of tachometric generators, or difficult to use, as in the case of electronic correlators, and they are practically unusable for certain kinds of measurements owing to the ambient temperature conditions. For another, this procedure does not take account of spurious variations in the rolling force, in particular the voluminal flow of the product being rolled. This results in a certain imprecision in the calculation of the amount of the slip, which is consequently maintained at a value such that each stand exerts a traction on the metal. Of course a slight traction on the metal is altogether preferable to a compression of the metal, even at the risk of an eventual compression.

A procedure has been developed to obviate these well known disadvantages, and this procedure is covered by French Pat. No. 2 354 154, which corresponds to U.S. Pat. No. 4,126,028 to Chapront, issued Nov. 21, 1978, assigned to the assignee of the present invention. This procedure works as follows. Just prior to the introduction of the metal into the second stand, the value of the rolling couple, i.e.; the rolling torque, of the first stand is determined and recorded. Then, when the metal is introduced into the second stand, the value of the rolling torque of the first stand is held constant by controlling the reference speed of the speed regulator for this first stand. Immediately thereafter, the relation between the speeds of the two stands is held constant by controlling the main reference of the torque regulator for the first stand. This procedure does not, however, take account of possible variations in the cross-section of the metal such as may result from non-negligible traction or compression forces.

The object of the present invention is to obviate all the aforementioned drawbacks with an improved procedure and device for rolling metals without stress.

Other objects will be explained hereinafter and are pointed out in the appended claims.

The procedure in the invention has three key stages: In the first stage, just prior to the introduction of the metal into a stand (n+1), the value of the rolling torque in a stand (n) is determined and recorded. Then, in the second stage, when the metal is introduced into stand (n+1), the value of the rolling torque in stand (n) is held constant by controlling the speed regulator of stand (n) up to the time the metal is introduced into another stand (n+2). Finally, in the third stage, which continues until the rolling operation in stand (n) has been completed, the voluminal flow of the metal is held constant at the line of each stand by applying a multiplier coefficient to the signal representing the ratio between the speeds of two successive stands.

In summary, from one of its aspects, the invention embraces a procedure for rolling metals without stress applicable to a continuous rolling mill with at least two successive non-reversible stands, and including, for each stand, a torque regulator and a speed regulator, each acting on a circuit controlling the drive motor for said stands, and including a first stage, just prior to the introduction of the metal into stand (n+1), during the course of which the value of the rolling torque of stand (n) is determined and recorded, followed by a second stage, beginning with the introduction of the metal into stand (n+1), during which the value of the rolling torque of stand (n) is held constant by controlling the speed regulator of stand (n), characterized in this, that the aforesaid second stage continues up to the instant before the introduction of the said metal into stand (n+2), this being followed by a third phase, which continues until rolling in stand (ni) is complete during which the voluminal flow of the said metal is held constant at the line of each stand.

The invention will be understood more clearly and further purposes, advantages, and characteristics of it will become more apparent once the following description of one form of realization has been read. This description is not limitative in any way. Two drawings have been attached.

Figure 2:
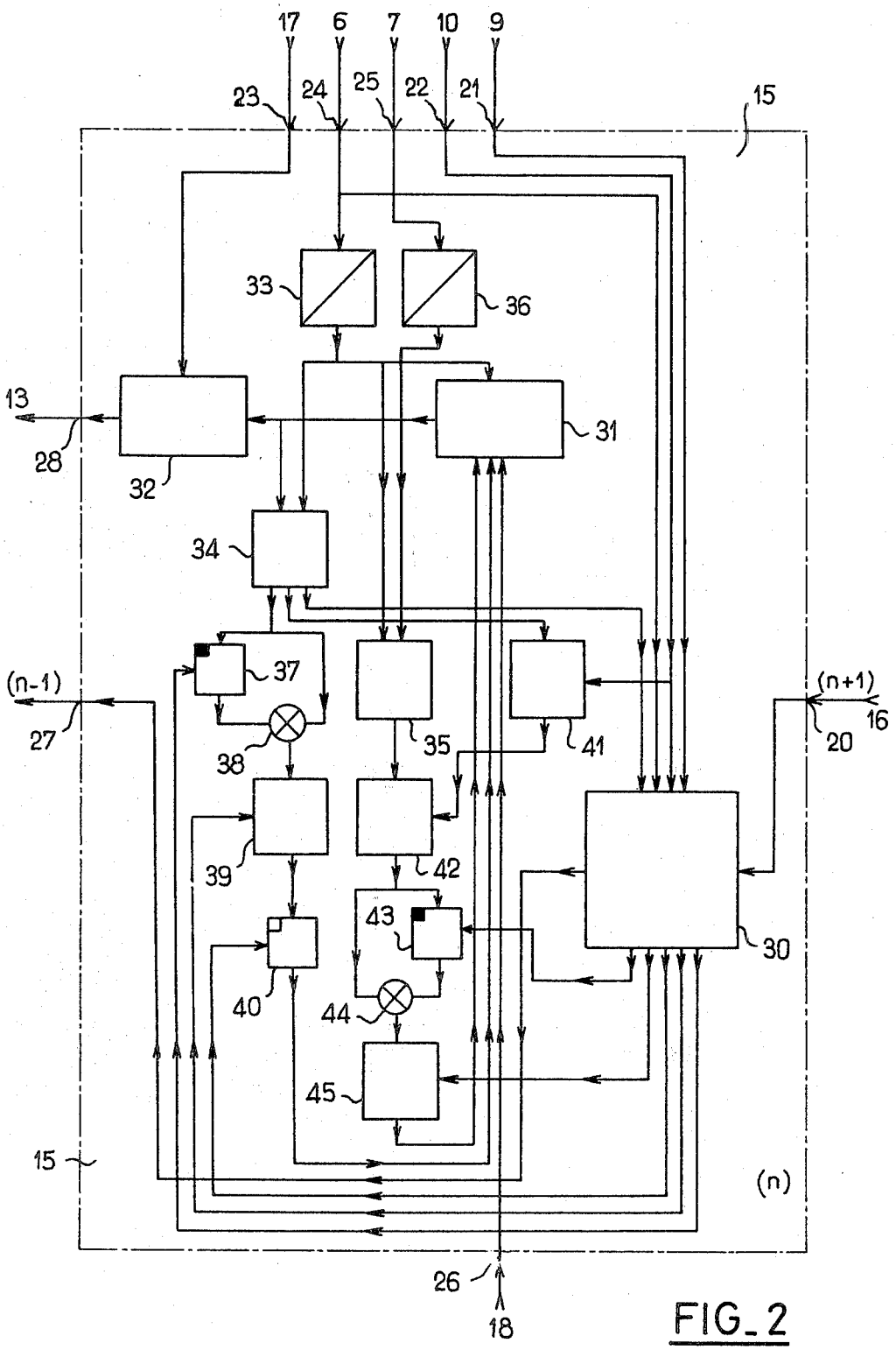

FIG. 1 represents an overview of the operation of two successive non-reversible stands in a continuous rolling mill for long products incorporating the invention, and FIG. 2 gives more complete details concerning one of the control units indicated in FIG. 1.

Referring now to FIG. 1, metal 1 is introduced between the cylinders of a preceding rolling stand (n), 2, before being introduced into a succeeding rolling stand (n+1), 3. Continuous, non-reversible rolling mills generally include a number of successive stands, here designated symbolically by the letters (n), (n+1), and so on, where n is an integer greater than or equal to 1.

Each stand is equipped with a drive motor, 4 and 5 respectively, coupled to a pulse generator, 6 and 7, whose output frequency is proportional to the speed of rotation of the motor to which it is coupled.

At the head of each stand, a photocell, 8, 9, or similar device makes it possible to tell the exact moment when the metal is introduced into the stand, while a strain gauge, 10, 11, placed in each stand generates a signal representing the rolling stress of the corresponding stand.

Drive motors 4 and 5 are fed from the power line, 12, through converters 13 and 14, which may, for example, incorporate thyristors.

These converters are controlled, respectively, by control units 15 and 16, whose design will be studied in greater detail using FIG. 2.

Each control unit (e.g., unit 15 associated with stand (n)) is fed information from the control unit associated with the next higher-numbered, i.e., succeeding, stand (in this case, control unit 16 associated with stand (n+1) through its input 20. Through its inputs 21, 22, 23, 24, and 25 it receives signals issuing, respectively, from photocell 9 situated at the input to stand (n+1); strain gauge 10 situated in stand (n), 2; current detector 17, which measures the current flowing in converter 13, which it controls; and pulse generators 6 and 7, attached to stands (n) and (n+1). In addition, a general speed reference signal 1 for all the stands is applied to input 26 of all the control units in such a way as to cause the rolling speed of the entire mill to vary uniformly.

Finally, each control unit 15, 16 has at least two outputs, 27 and 28, one of which is connected to the control unit downstream and the other to the converter 13, 14 which it controls.

Control unit 15 for stand (n) is shown in greater detail in FIG. 2, with the same references.

Essentially, control unit 15 contains, apart from logic element 30, a speed regulator, 31, whose output is connected to a current regulator 32, which is itself connected to input 23 of the control unit, an input that is connected to detector 17. Regulator 32 is connected to output 28 of control unit 15 that is connected to converter 13. The signal coming from pulse generator 6 is fed through input 24 of control unit 15 to a converter, 33, which generates a numerical output signal representing the pulse frequency. This output is connected first to speed regulator 31 and second to a circuit that determines the rolling torque, 34, which is also connected to the output of speed regulator 31, and finally the output is connected to a divider circuit, 35, which determines the ratio of the speeds of stands (n) and (n+1). The other input of this divider is fed the numerical signal from converter 36, which is identical to converter 33 but connected to input 25 of control unit 15 that is connected to pulse generator 7 connected to motor 5 of stand (n+1).

One of the outputs of circuit 34 for determining the rolling torque is connected to one of the inputs of speed regulator 31 through a feedback loop for regulating the rolling torque of stand (n). This loop includes, in a known fashion, a primary memory 37, a comparator 38, and a torque regulating circuit 39, which operates during the first stage of the procedure as described above. It also includes a second memory, 40, which is used during the second stage of the procedure. Torque-determining circuit 34 also has an output that is connected to one input of a multiplier coefficient generator circuit 41, which generates a multiplier coefficient. Another input of this circuit is connected to input 22 of control unit 15, which is connected to strain gauge 10 located in stand (n).

Multiplier coefficient generator 41 is connected to a multiplier circuit, 42, whose other input receives a signal coming from divider circuit 35.

The output of multiplier circuit 42 is connected to one of the inputs of speed regulator 31 through a feedback loop for regulating the flow of the rolled metal, which operates during the third phase of the procedure. This last loop includes a memory 43, a comparator 44, and a flow regulator 45.

Finally, speed regulator 31 has an input that is connected to input 26 of control unit 15, to which is fed the general speed reference signal 18.

The inputs of logic circuit 30 are connected to inputs 24, 22, 21, and 20, respectively, of control unit 15 and to one output of the rolling-torque determining circuit 34, while its outputs are connected to output 27 of control unit 15, which is tied to the control unit of stand (n−1), and respectively to the control plugs of memories 37 and 40 and the torque regulating circuit 39, as well as to the control plugs of memory 43 and flow-regulating circuit 45.

The device works as follows: startup of stand (n), 2, is detected by the appearance of a rolling torque in motor 4 or else by means of strain gauge 10.

Just prior to the introduction of the metal, 1, into stand (n+1), 3, the value of the rolling torque, which is then being carried out without strain, is determined by rolling torque determining circuit 34 and recorded in memory 37. The precise timing can be accomplished by, say, a photocell, 9, situated at the intake to stand 3 as shown in FIG. 1, or by a counter connected to the output of pulse generator 6, since the distance between the two stands is of course accurately known.

When the metal, 1, is introduced into stand (n+1), 3, as detected by strain gauge 11 or by the appearance of a rolling torque in motor 5, the value of the rolling torque in stand (n), 2, is held constant by means of the feedback loop connected to speed regulator 31, which is controlled in a known manner by logic 30. Just prior to the introduction of the metal into the next succeeding stand (n+2) (not shown), the correction signal coming from comparator 38 is recorded in memory 40 and is constantly fed, until rolling is complete, to speed regulator 31. Logic circuit 30, which has already controlled the foregoing sequence of operations, then causes the flow-control feedback loop to come into operation until rolling in stand (n) is complete. Regulation of the flow is obtained by applying a corrective term to the speed ratio. This corrective term is a variable multiplier coefficient which is an expression of the form 1+k, where k is a function of, among other things, the separation force between the cylinders in the stand in question, the yield coefficient in the same stand, the radius of the cylinders, and also the thickness of the slit between the cylinders, particularly at the neutral point. This corrective term is worked out by multiplier coefficient generator 41 and applied to the ratio between the speeds of stands (n) and (n+1) by means of multiplier circuit 42. The signal coming from circuit 42 is then processed by the flow-regulating feedback loop, which may be identical to the one that regulates the speed of the stands.

Such a procedure works well for rolling long products such as rails, profiled pieces, and girders, where the product, in the course of rolling, is simultaneously engaged in several non-reversible stands. In this situation, tractions or compressions of the product between two successive stands causes distortions in the desired profile of the finished product. The procedure described in the invention makes it possible to eliminate drawbacks of this sort.

Although only one mode of realization of the procedure has been described, it is clear that modifications will be made by those skilled in the art in the same spirit and fall within the present description.

We claim:

1. A method of rolling metal without stress in a continuous rolling mill that has a plurality of successive non-reversible stands, and has, for each stand, a torque regulator and a speed regulator, each acting upon a circuit that controls a drive motor for the stand, the method comprising determining and recording the value of the rolling torque of a preceding stand (n) just prior to the introduction of the metal into a succeeding stand (n+1); controlling the speed regulator of the preceding stand to hold the value of the rolling torque constant, said controlling beginning upon the introduction of metal into the succeeding stand and continuing up to an instant just prior to the introduction of the metal into a next succeeding stand (n+2) following said succeeding stand; and maintaining constant the voluminal flow of metal from each stand until rolling in the preceding stand is complete, said maintaining comprising controlling the speed regulator of the preceding stand.

2. A method of rolling metal without stress in a continuous rolling mill that has a plurality of successive non-reversible stands, and has, for each stand, a torque regulator and a speed regulator, each acting upon a circuit that controls a drive motor for the stand, the method comprising determining and recording the value of the rolling torque of a preceding stand (n) just prior to the introduction of the metal into a succeeding stand (n+1); controlling the speed regulator of the preceding stand to hold the value of the rolling torque constant, said controlling beginning upon the introduction of metal into the succeeding stand and continuing up to an instant just prior to the introduction of the metal into a next succeeding stand (n+2) following said succeeding stand; and maintaining constant the voluminal flow of metal from each stand until rolling in the preceding stand is complete by applying a variable multiplier coefficient to a signal representing the ratio of the speeds of the preceding and succeeding stands, processing the resulting signal in a flow-regulating circuit, and providing an output from said flow-regulating circuit to the speed regulator of the preceding stand.

3. The method of claim 2 further comprising monitoring the value of the rolling stress of the preceding stand, and wherein the variable multiplier coefficient is generated from the value of the rolling torque and the value of the rolling stress of the preceding stand.

4. Apparatus for rolling metal without stress in a continuous rolling mill having a plurality of successive non-reversible stands, and having, for each stand, a torque regulator and a speed regulator that are connected to a converter circuit that controls a drive motor for the stand, the apparatus comprising means for determining the rolling torque of a preceding stand just prior to the introduction of metal into a succeeding stand; means operable upon the introduction of the metal into the succeeding stand for controlling the speed regulator of the preceding stand to hold said value of rolling torque constant until just prior to the introduction of the metal into a next succeeding stand following said succeeding stand; and means for maintaining constant the voluminal flow of metal from each stand until rolling in the preceding stand is complete, the last-mentioned means comprising means for controlling the speed regulator of the preceding stand.

5. Apparatus for rolling metal without stress in a continuous rolling mill having a plurality of successive non-reversible stands, and having, for each stand, a torque regulator and a speed regulator that are connected to a converter circuit that controls a drive motor for the stand, the apparatus comprising means for determining the rolling torque of a preceding stand just prior to the introduction of metal into a succeeding stand; means operable upon the introduction of the metal into the succeeding stand for controlling the speed regulator of the preceding stand to hold said value of rolling torque constant until just prior to the introduction of the metal into a next succeeding stand following said succeeding stand; and means for maintaining constant the voluminal flow of metal from each stand until rolling in the preceding stand is complete, wherein said maintaining means comprises means for generating a signal representative of the ratio of the speeds of the preceding to the succeeding stands, means for applying a variable multiplier coefficient to said signal to produce a resultant signal, and a flow-regulating circuit for precessing the resultant signal and for providing a control signal to the speed regulator of the preceding stand.

6. The apparatus of claim 5, wherein said signal generating means comprises a first pulse generator coupled to the drive motor of the preceding stand, a second pulse generator coupled to the drive motor of the succeeding stand, each pulse generator having an output frequency that is proportional to the speed of rotation of the motor to which it is coupled, first and second numerical converters connected to the first and second pulse generator outputs, respectively, each converter providing a numerical output signal representative of its input pulse frequency, and a divider circuit for forming the ratio of the output signal from the first converter to the output signal from the second converter.

7. The apparatus of claim 5, wherein said means for applying a variable multiplier coefficient comprises a multiplier coefficient-generating circuit that receives as inputs an output from said rolling torque-determining means and an output from a strain gauge associated with said preceding stand and provides as an output the variable multiplier coefficient, and a multiplier circuit that receives as inputs said signal representative of said speed ratio and said variable multiplier coefficient and provides an output representative of the product thereof, said output being said resultant signal.

8. The apparatus of claim 5, wherein said controlling means comprises means for detecting the introduction of metal into the succeeding stand, means responsive to said detecting means for storing the value of the rolling torque determined by said determining means, and means for thereafter comparing the stored value of rolling torque with the value of rolling torque determined by said determining means and for producing a correction signal, the torque regulator being responsive to the correction signal for providing a control signal to the speed regulator of the preceding stand.

9. The apparatus of claim 8, wherein said maintaining means comprises another detector means for detecting the presence of metal just prior to its introduction into said next succeeding stand, means responsive to said other detector means for storing the value of the control signal, and means for thereafter applying said stored control signal value to the speed regulator of the preceding stand until rolling in the preceding stand is complete.

* * * * *